US007866719B1

(12) United States Patent
Lucca

(10) Patent No.: US 7,866,719 B1
(45) Date of Patent: Jan. 11, 2011

(54) APPARATUS AND METHOD FOR COLLECTION, STORAGE, AND ACCESS OF BASEBALL-LIKE OBJECTS

(76) Inventor: Gaudencio Lucca, 107 Hilary Ave., Mountain View, CA (US) 94040

( * ) Notice: Subject to any disclaimer, the term of this patent is extended or adjusted under 35 U.S.C. 154(b) by 130 days.

(21) Appl. No.: 11/546,620

(22) Filed: Oct. 11, 2006

Related U.S. Application Data

(60) Provisional application No. 60/726,722, filed on Oct. 14, 2005.

(51) Int. Cl.
*A63B 47/02* (2006.01)

(52) U.S. Cl. ..... 294/19.2; 473/173

(58) Field of Classification Search ..... 294/19.2; 473/173; 206/315.9; 56/328.1; 414/439, 414/440

See application file for complete search history.

(56) References Cited

U.S. PATENT DOCUMENTS

| | | | | |
|---|---|---|---|---|
| 1,937,828 A | | 12/1933 | MacDonald | 273/66 |
| 2,027,546 A | | 1/1936 | MacDonald | 273/66 |
| 2,203,170 A | | 6/1940 | MacDonald | 294/19 |
| 3,258,286 A | * | 6/1966 | Coward | 294/19.2 |
| 3,901,545 A | * | 8/1975 | Shott | 294/19.2 |
| 3,982,781 A | * | 9/1976 | Tucker et al. | 294/19.2 |
| 4,295,648 A | * | 10/1981 | Stromback | 473/456 |
| 5,026,061 A | * | 6/1991 | Davis | 473/173 |
| D374,697 S | | 10/1996 | McKnight | D21/206 |
| 5,755,632 A | * | 5/1998 | Eddy | 473/460 |
| 6,142,544 A | * | 11/2000 | Benzoni et al. | 294/19.2 |
| 6,354,643 B1 | * | 3/2002 | Podejko | 294/19.2 |
| 6,412,839 B1 | * | 7/2002 | Tran | 294/19.2 |
| 6,945,578 B2 | | 9/2005 | Hellerson | 294/19.2 |
| 2004/0227365 A1 | | 11/2004 | Hellerson | 294/19.2 |
| 2005/0023850 A1 | | 2/2005 | Hellerson | 294/19.2 |

* cited by examiner

*Primary Examiner*—Dean J Kramer
(74) *Attorney, Agent, or Firm*—Haverstock & Owens LLP

(57) ABSTRACT

An apparatus to aid and simplify collection of substantially non-deformable balls scattered across a field or small area, and to provide a place for easy storage and retrieval. The apparatus utilizes stretchable and resilient members located in a ball intake area to transfer the substantially non-deformable balls from the ground or surface, into the apparatus. This disclosure describes methods, specific devices, and mechanisms embodying the present invention and useful in the collection or storage of baseball-like objects, and which provides easy access to stored baseball-like objects.

37 Claims, 13 Drawing Sheets

APPARATUS AND METHOD FOR COLLECTION, STORAGE, AND ACCESS OF BASEBALL-LIKE OBJECTS

RELATED APPLICATIONS

This application claims benefit of priority under U.S.C. section 119(e) of U.S. Provisional Patent Application 60/726,722, filed Oct. 14, 2005, and entitled "Apparatus and Method for Collection, Storage, and Access of Baseball-Like Objects," which is incorporated herein by reference in its entirety.

FIELD OF THE INVENTION

The present invention is related to the collection, storage and access of balls. More specifically, the present invention relates the collection, storage and access of substantially non-deformable balls.

BACKGROUND

A variety of apparatus exist for collecting deformable sports balls, such as tennis balls. For example, some tennis ball collectors include a metal basket with a grid-like bottom surface and two rigid handles. With enough pressure, a tennis ball can squeeze through the spaces within the grid. When the handles are positioned for carrying, someone holding the collector can force the bottom surface of the basket onto a tennis ball that rests on a court or other hard surface, pressing the ball through one of the grid spaces. Repeating this process fills the basket with tennis balls. Once the basket contains some tennis balls, the handles can be repositioned to sit below the basket, acting as legs that support the basket so the collector acts as a convenient storage device for retrieving tennis balls to use for practice or play. The operating principle of these tennis ball collectors depends on the deformability of tennis balls.

Currently, there are no apparatus or methods that aid and simplify the collection, storage, and retrieval of baseballs, softballs or other substantially non-deformable balls that must be manipulated by hand for use.

SUMMARY

The embodiments presented in this disclosure attempt to aid and simplify collection of baseballs or softballs or other hard balls scattered across a field or small area, and to provide a place for easy storage and retrieval. This disclosure describes methods, specific devices, and mechanisms embodying the present invention and useful in one or more of the collection, storage, and use of substantially non-deformable balls.

Stretchable and resilient structures are used in a number of embodiments to collect the substantially non-deformable balls.

In some embodiments, the present invention relates to a tube, bucket or box like storage container adapted to engage and capture baseballs or softballs. In some embodiments of the present invention, the apparatus is configured for the collection of balls and to permit easy access to the balls. Preferably, these embodiments also include attachments or portions of the containers for use in target practice. In some embodiments of the present invention, the apparatus is configured to vertically stack successively collected balls within the apparatus in order to get the balls to the height of a user's hand. In some embodiments handles, wheels, or legs are used.

DESCRIPTION OF THE DRAWING FIGURES

DETAILED DESCRIPTION OF THE VARIOUS EMBODIMENTS

Figure 1:
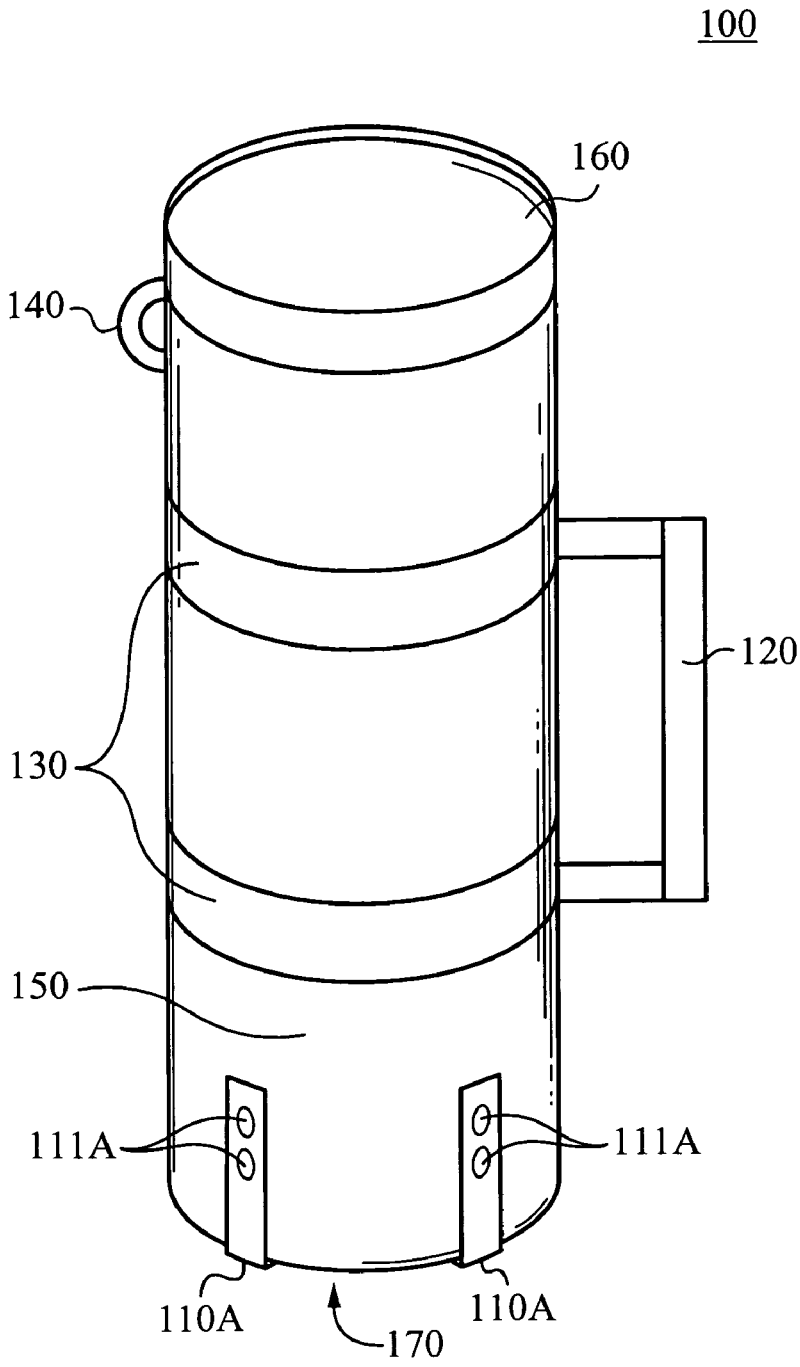
FIG. 1 is a perspective view of a ball storage container in accordance with the present invention.

One embodiment of the present invention is depicted in FIG. 1. The ball storage device 100 depicted in FIG. 1 is tube-like, but other embodiments use other shapes. The storage device 100 includes a handle 120 coupled with the tube structure 150 via the bands 130. The handle 120 permits carrying of the storage device 100 and collection of balls using the device. The lanyard ring 140 also is useful for carrying or transport of the storage device 100. The lid 160, the brackets 110A and the bottom of the device (not shown) prevent balls from accidentally escaping the storage device 100. Preferably, the lid 160 attaches to the tube structure 150 via an interference fit. The brackets 110A are coupled with the tube structure 150 via the fasteners 111A. The bottom of the device (not shown) is configured with a ball capture mechanism, which is explained below.

To use the storage device 100 to collect balls, a person need only press the bottom of the tube structure 150 onto the top portion of the ball, and then push down on the tube to engage and capture the ball. This process can be repeated until a desired number of the balls are collected or the tube is full. Then, by opening the lid 160 of the tube, a person can access the balls. The tube could have supports to maintain it in an upright position, but these are not included in the illustrated embodiment.

In the preferred embodiment of the present invention, the ball storage device is used to collect substantially non-deformable balls. A substantially non-deformable ball generally will not deform, compress, or misshape with the application of force on its surface. Conversely, a substantially non-deformable ball exerts a resisting force on an object pushing on its surface, and will cause a bendable or stretchable object to bend or stretch when the bendable or stretchable object exerts a downward force on the ball.

Figure 2A:
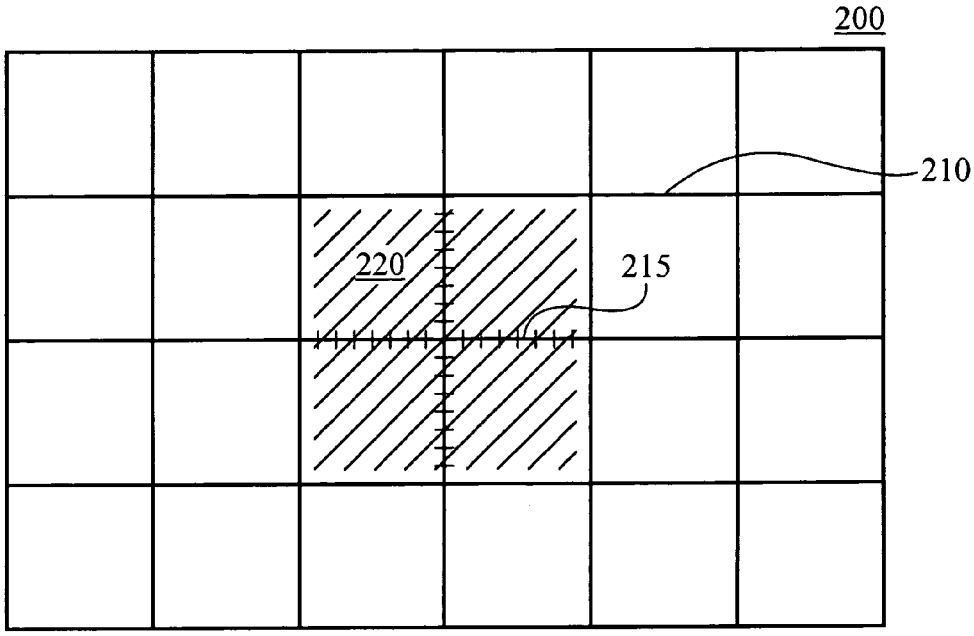
FIG. 2A is a schematic view of a through-basket ball engagement and capture mechanism for inclusion in a ball storage apparatus in accordance with the present invention.
Figure 2B:
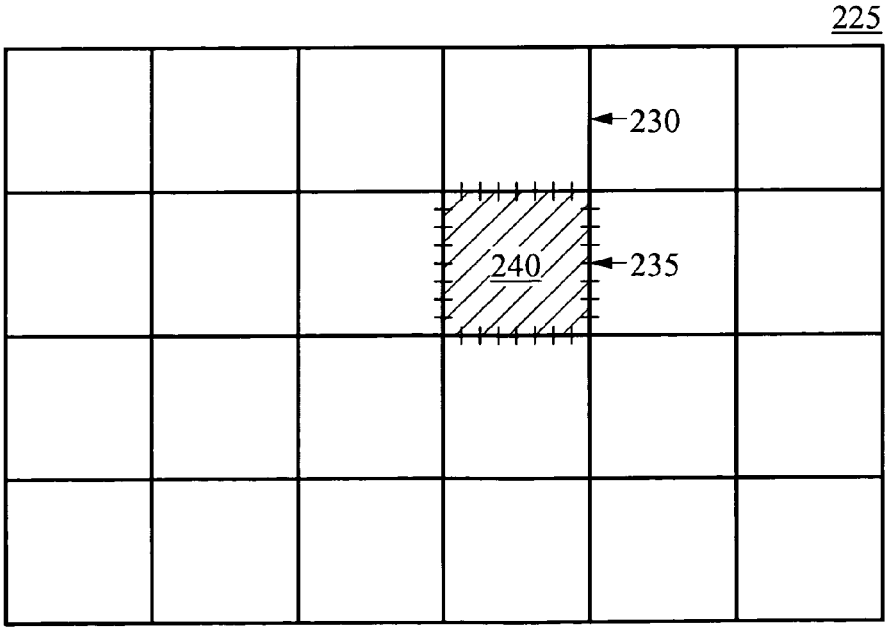
FIG. 2B is a schematic view of an alternative through-basket ball engagement and capture mechanism for inclusion in a ball storage apparatus in accordance with the present invention.
Figure 2C:
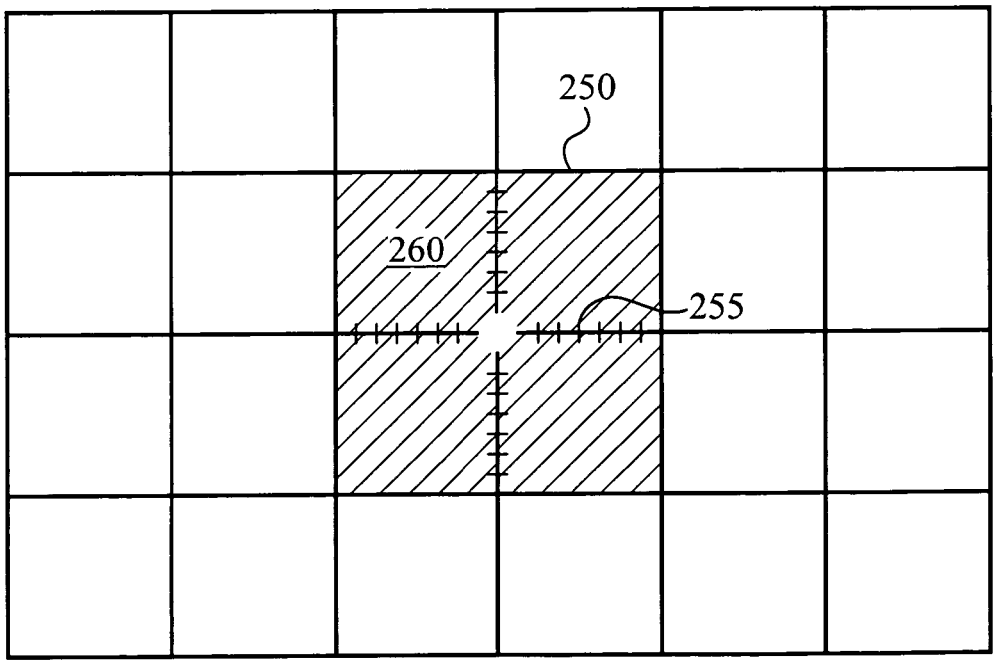
FIG. 2C is a schematic view of yet another alternative through-basket ball engagement and capture mechanism for inclusion in a ball storage apparatus in accordance with the present invention.

FIGS. 2A, 2B and 2C are schematic views of the capture mechanisms for collecting balls into the ball storage device in accordance with some embodiments of the present invention. These mechanisms could be included in the embodiments described in FIG. 1 or in embodiments disclosed below.

In the ball capture mechanism 200, the bottom of a ball storage device comprises a grid structure, a first portion of which comprises a plurality of rigid members 210, and a second portion of which comprises a plurality of flexible members 215. The flexible members 215 define a ball capture portion 220.

To use the ball storage device, a user pushes down on the device and presses the ball capture portion 220 against a ball. The force caused from a user's pushing forces the flexible members 215 to stretch, forming an opening just large enough to admit the ball into the basket. The ball pushes through the ball capture portion of the grid structure, after which the flexible members 215 recoil to their original positions. For example, the flexible members 215 are either rubber or elastic. Referring to FIG. 2B, the ball capture portion 225 works in much the same way. The grid comprises rigid members 230 and flexible members 235. The flexible members 235 define the ball capture portion 240.

There are certain advantages to each configuration. If the flexible members 215 and 235 are equally flexible, and the rigid members 210 and 230 equally rigid, and assuming the grid spacings in the mechanisms 200 and 225 are the same, the ball capture portion 240 is more yielding, permitting use with a greater range of balls because all four edges of the admitting grid are flexible instead of only two. However, the ball capture portion 220 provides a greater area for ball capture and thus greater ease of use.

FIG. 2C is yet another example of the ball capture portion of the present invention. In FIG. 2C, rigid members 250 surround a ball capture zone 260 which is larger than the ball the user desires to collect. Four flexible members 255 cross the ball capture zone without completely connecting in the middle, providing an opening for a ball. The flexible members are rigid enough to retain collected balls, but flexible enough to stretch over a laying ball with adequate force by a user.

Numerous other configurations exist for the choice of ball capture zone size and placement of the flexible members. Such configuration is made with an eye toward the desired range of ball sizes to be collected and the desired ease of use.

Figure 3A:
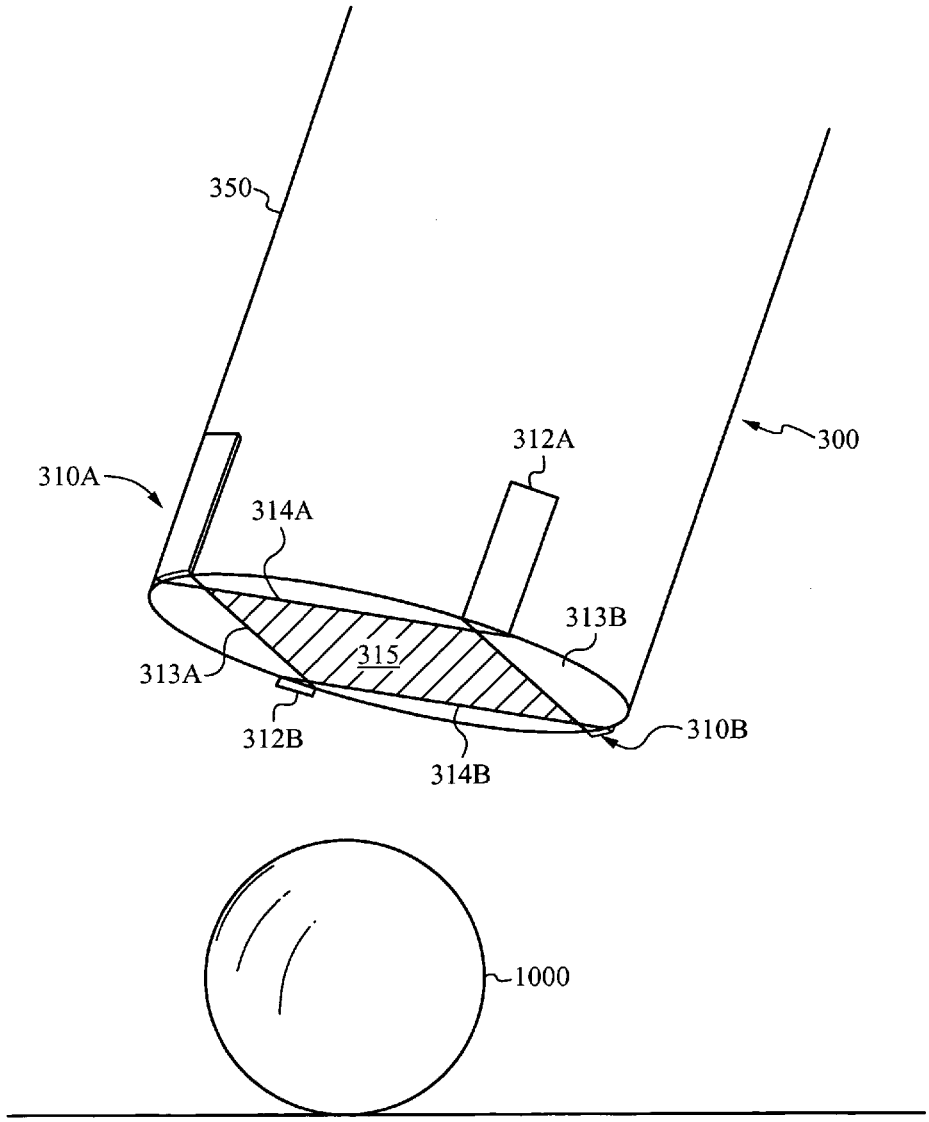
FIG. 3A is a perspective view of a ball storage container in accordance with the present invention.

FIG. 3A is a perspective view of a simplified ball collection device according to one embodiment of the present invention. As depicted in the picture, the ball collection device is positioned over a ball 1000. As an example, the ball 1000 is a hardball-type baseball which does not substantially deform with the application of pressure. The device is a tube structure 350 with four brackets 310A, 310B, 312A, and 312B holding a ball capturing portion 315. Resilient members 313A, 313B, 314A, and 314B stretch around the ball 1000 with adequate downward pressure.

Figure 3B:
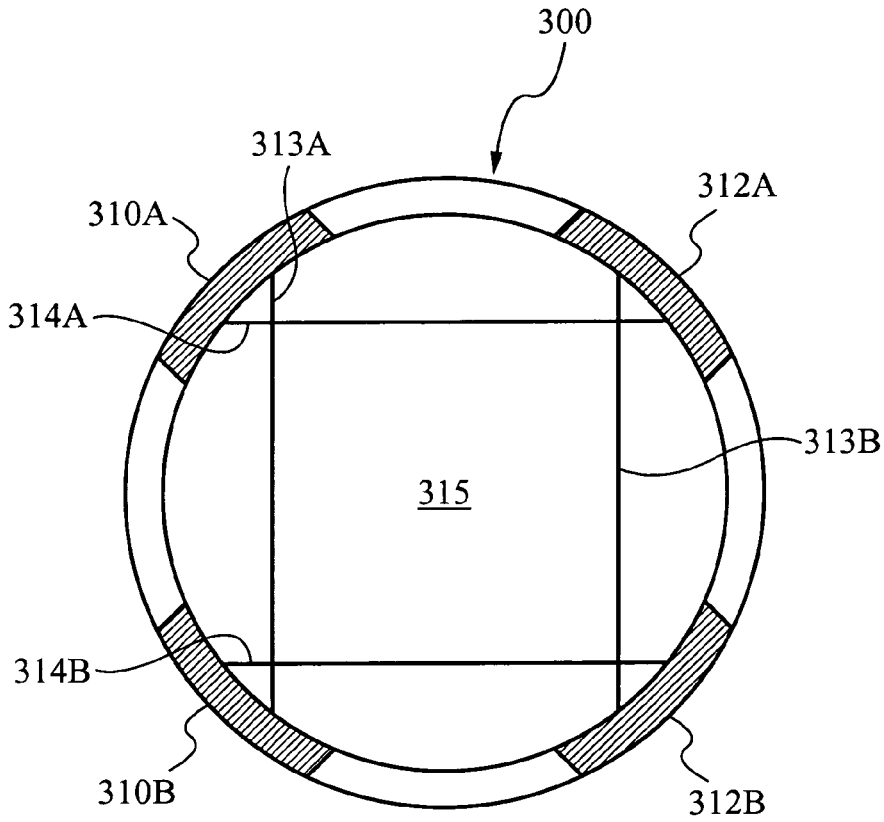
FIG. 3B is an axial schematic view of a ball storage container in accordance with the present invention.

FIG. 3B is a bottom view of the simplified grid capturing device on the bottom of ball storage device 300. The four brackets 310A, 310B, and 312A and 312B are positioned around its bottom edge. The brackets 310A and 310B support the resilient structure 313A, the brackets 312A and 312B support the resilient structure 313B, the brackets 310A and 312A support the resilient structure 314A, and the brackets 310B and 312B support the resilient structure 314B. The four resilient members define the ball capturing portion 315.

Figure 3C:
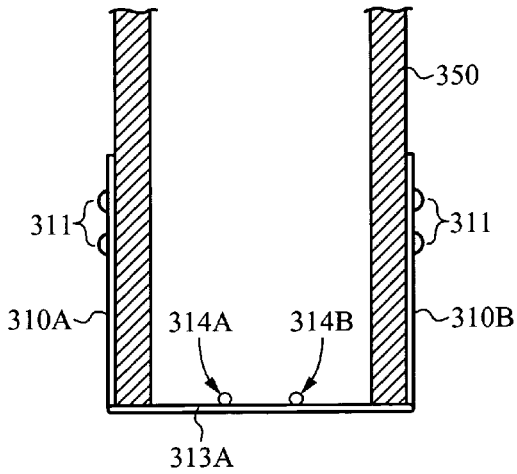
FIG. 3C is a cross-sectional view of a ball storage container in accordance with the present invention.

FIG. 3C illustrates a cross section of the empty ball storage device 350. The brackets 310A, 310B, 312A (not shown) and 312B (not shown) are coupled to the tube structure 350 via the fasteners 311 and support the bendable and resilient structure 313A, 313B (not shown), 314A and 314B. In FIG. 3C, the bendable and resilient member 313A, 313B (not shown), 314A, and 314B are in their rest position.

Figure 3D:
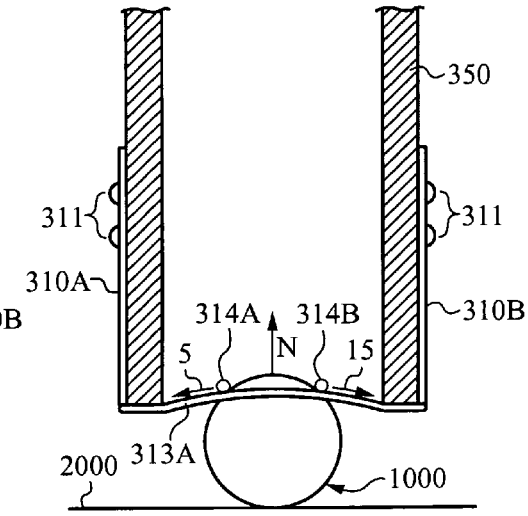
FIG. 3D is a cross-sectional view of a ball engaging with a storage container in accordance with the present invention.

FIG. 3D illustrates a ball 1000 entering an engaged position within the tube structure 350. Here, the tube structure 350 is being forced down onto the ball 1000, so that a normal force N of the surface 2000 upon which the ball rests maintains the ball in position, the ball 1000 displaces the bendable and resilient structures, 313A, 313B (not shown), 314A, and 314B, out of their rest positions. The bendable and resilient structures 314A and 314B are displaced in the directions 5 and 15 respectively, while the bendable and resilient structures 313A and 313B (not shown) are displaced up towards the top of the tube structure 350 as shown. Further, the bendable and resilient structure 313A extends toward the viewer (out of the page), and the bendable and resilient structure 313B (not shown) extends the opposite direction, away from the viewer (into the page). The brackets, e.g. 310A and 310B, maintain a connection with the bendable and resilient structures, e.g. 313A, causing restoring forces to develop within the bendable and resilient structures, urging them back towards their rest positions.

Figure 3E:
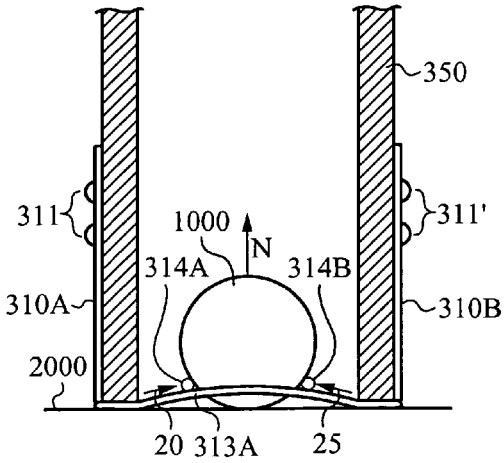
FIG. 3E is a cross-sectional view of a ball being captured within a storage container in accordance with the present invention.

As the tube structure 350 continues to be pressed downward onto the ball 1000, the bendable and resilient structures, e.g. 314A, 314B, 313A and 313B (not shown), are further displaced. They begin to move back towards their rest positions, as illustrated in FIG. 3E, after crossing an equatorial line of the ball 1000 (relative to a pole at the ball's point of contact with the surface 2000). As illustrated, the bendable and resilient structures 314A and 314B move in the directions 20 and 25 respectively. The bendable and resilient structure 313A moves back down, away from the interior of the tube structure 350, and away from the viewer (into the page). The bendable and resilient structure 313B (not shown) also moves back down, away from the interior of the tube structure 350, and toward the viewer (out of the page). Once the bendable and resilient structures begin to move back towards their rest positions, the ball enters a captured position.

Figure 3F:
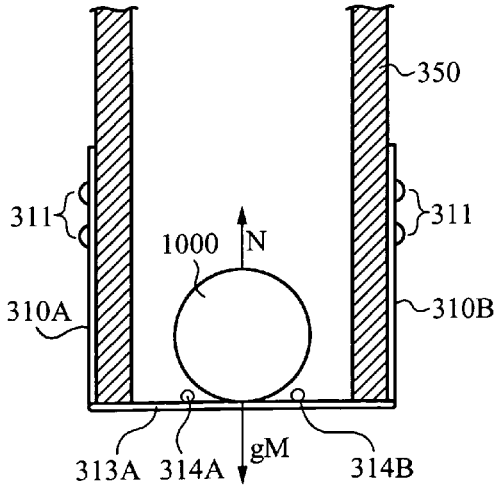
FIG. 3F is a cross-sectional view of a ball captured within a storage container in accordance with the present invention.

As depicted in FIG. 3F, once the bendable and resilient structures, e.g. 313A, 313B (not shown), 314A, and 314B, move back to their rest positions, the tube 350 is able to be lifted into a carrying position. As the tube structure 350 begins to move away from the surface 2000, the forces within the bendable and resilient structures prevent the ball 1000 from falling. Here, the bendable and resilient structures, e.g. 313A, 314A, and 314B, are in a rest position, and exert a normal force N on the ball 1000 to counteract the force of gravity gM, where M is the mass of the ball 1000. Once in the captured position, the ball is free to move throughout the space within the tube structure 350.

FIGS. 3A-F depict an elevator-style ball collection device. An elevator-style ball collection device is a device with a storage tube or container which has a cavity width which is only slightly bigger than the width of the ball the user wishes to collect. Successive balls collected cause the position of previously collected balls to raise vertically relative to the bottom of the device. An elevator-style collection device is useful for collecting balls as well as raising the collected balls to a convenient level where a user can grab them without bending over.

Figure 4:
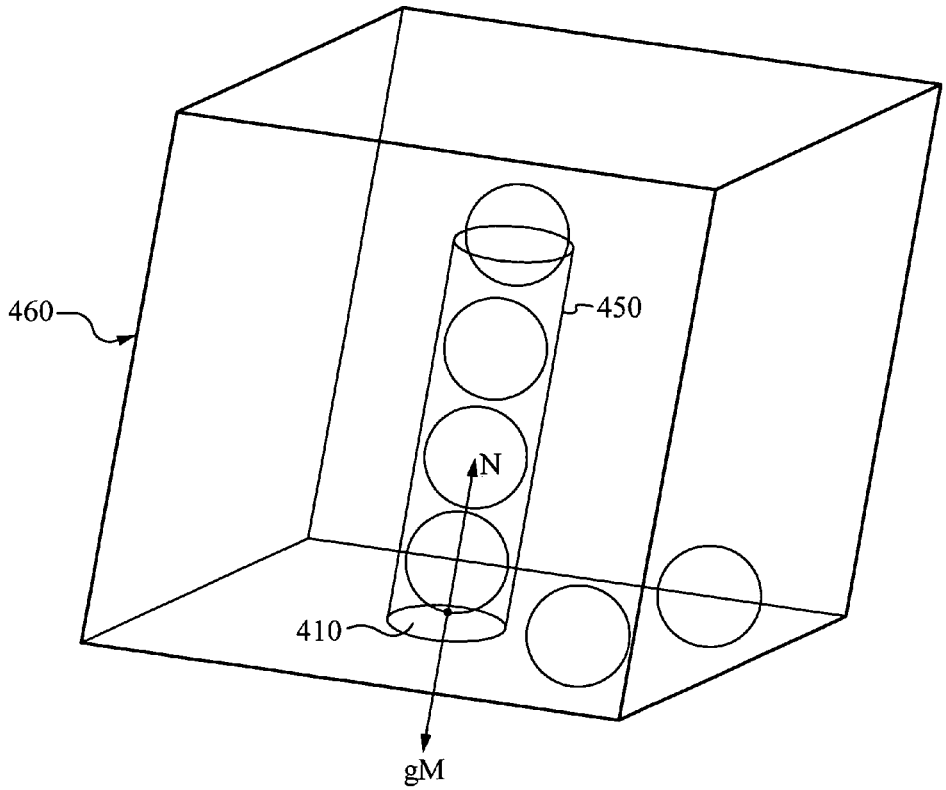
FIG. 4 is a perspective view of ball storage container in accordance with the present invention with a spill-over function.

FIG. 4 depicts one embodiment of the present invention. In FIG. 4, an elevator-style ball collection tube 450 is integrally formed within a larger container 460. The tube 450 is positioned in the center of the larger container 460 where there is a hole in the bottom of the larger container 460 to allow balls to enter the tube 450. A ball capturing portion 410 comprised of bendable and resilient members (not shown) is used to collect balls as described above. When successive balls enter the tube, previously collected balls are pushed up the vertical axis of the tube 450. The balls in the tube 450 combine to create a force gMtotal on the collection area 410, where Mtotal is the total mass of the balls in the tube 450. The total force due to gravity gMtotal exerted on the ball capturing portion increases as more balls are collected in the tube. The force due to gravity gMtotal reaches a critical point when it exceeds the upward normal force N, exerted on the balls by the resilient members. If this critical point is reached, one or more balls may fall out of the collection area. To avoid this problem, the tube 450 is a relatively short tube which only accommodates a few balls. In this configuration, once enough balls enter the tube 450, previously collected balls will spill over the top of tube 450 and into the larger container 460. Once a single ball spills over, it no longer contributes to the total exerted downward force on the collection area 410 due to gravity gMtotal, thus avoiding reaching the critical point and preventing balls from falling out of the device.

Figure 5A:
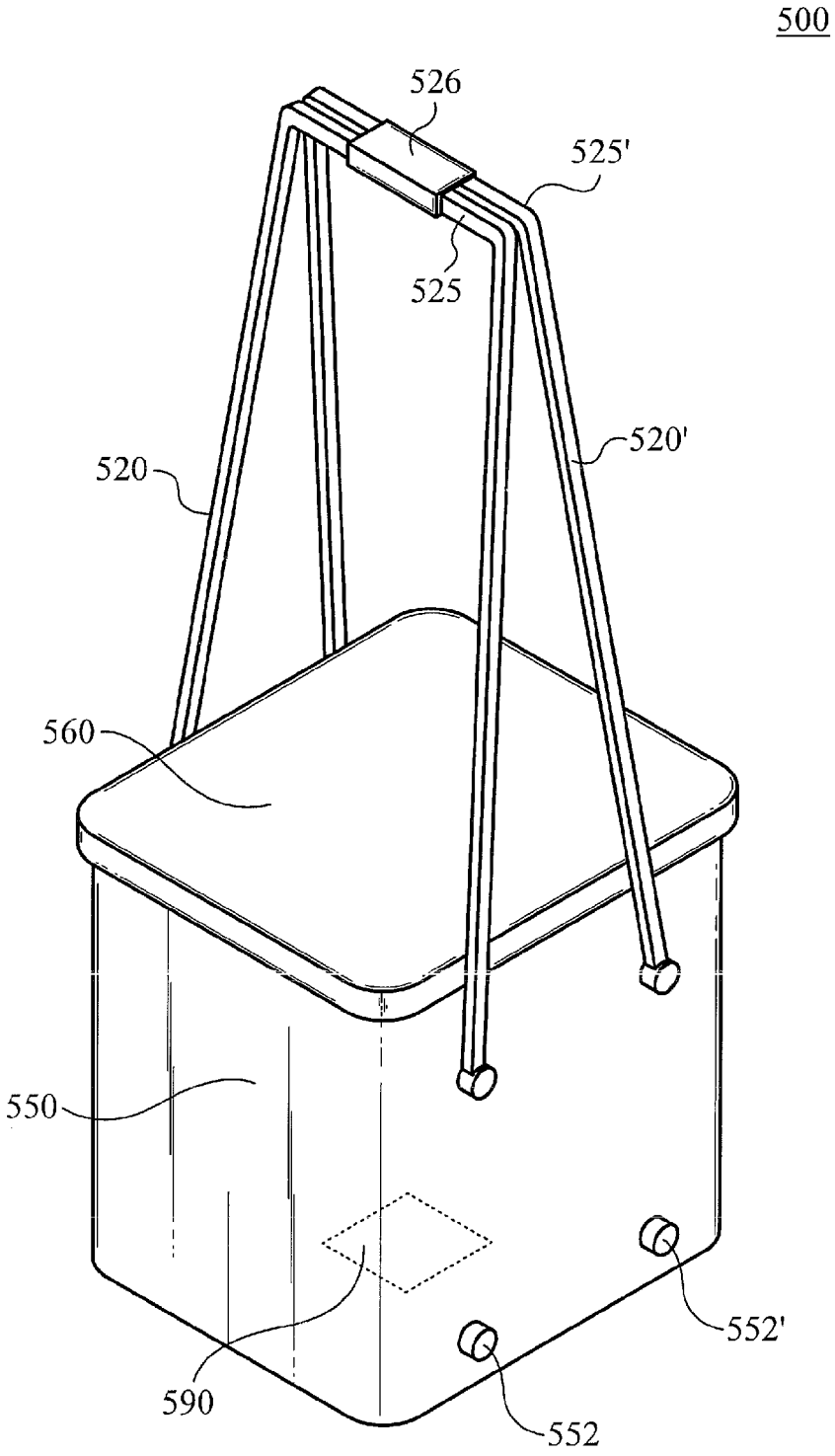
FIG. 5A is a perspective view of a box-like ball storage bucket in a carrying/collecting configuration in accordance with the present invention.

FIG. 5A is a perspective view of a ball storage device 500 in a carrying/collecting configuration in accordance with the present invention. This embodiment includes a box-like storage container 550, but could be designed with another shape. The device 500 has two handles 525 and 525' that are adjacent in the carrying/collecting configuration for convenient carrying. Preferably, but optionally, a clasp 526 attaches the handles 525 and 525' to one another. The handles are mounted on bails 520, 520' that are moveable and configurable in at least two positions: one to serve as a carrying handle, as illustrated in FIG. 5A, and one to support the device in an upright position, as illustrated in FIG. 5B.

When the bails 520, 520' are in the carrying position, a person holding the handles 525, 525' can position the bottom of the container 550 on the top portion of a ball (not shown), and push down on the handles 525, 525' to engage and capture the ball within the ball capture portion 590. By repeating this process, the person is able to collect multiple balls into the container 550.

Figure 5B:
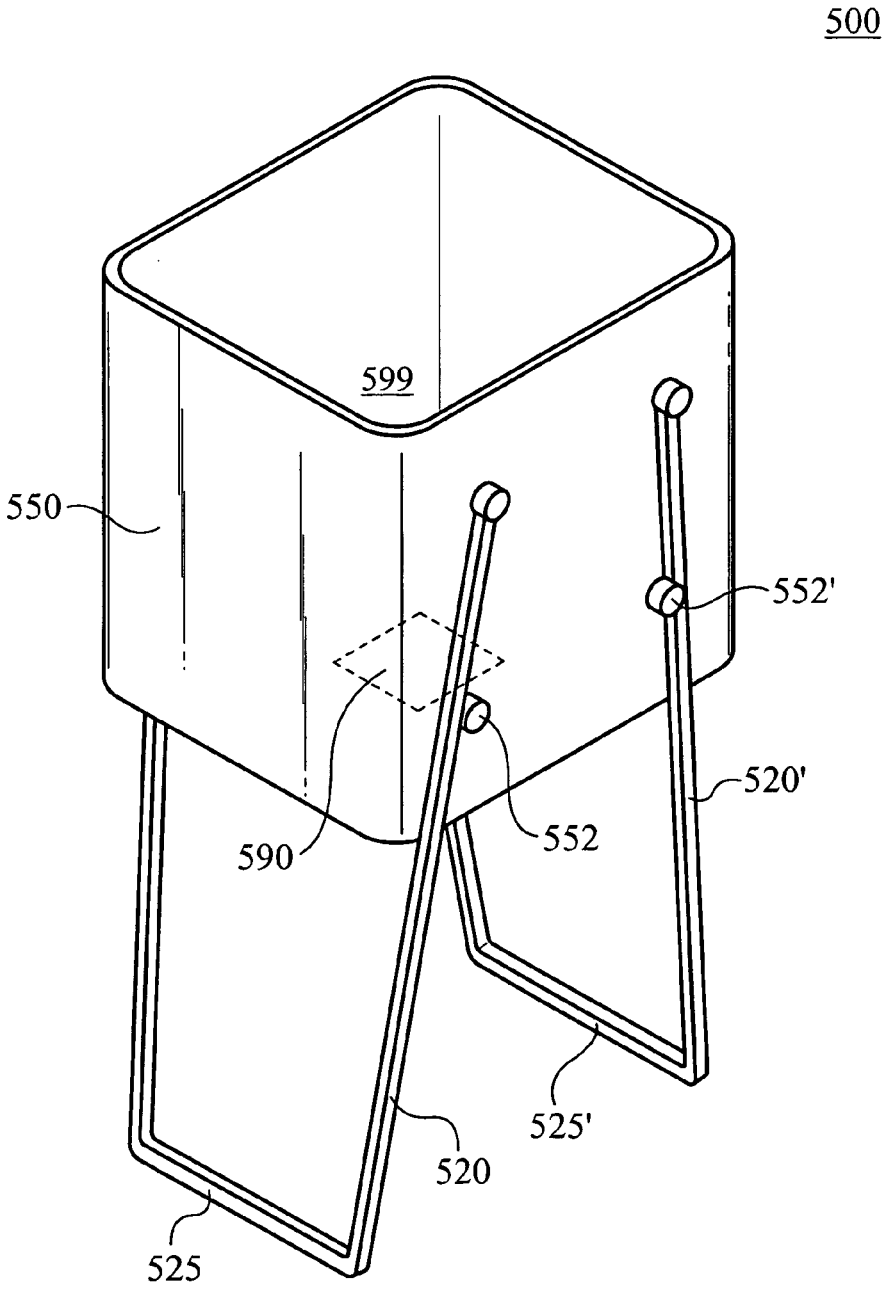
FIG. 5B is a perspective view of a box-like ball storage bucket in a ball access configuration in accordance with the present invention.

With balls in the container, placing the device 500 in the upright position illustrated in FIG. 5B facilitates easy access to retrieve the balls without bending down to the ground. In the upright position, the bails 520, 520' are coupled to the bail clips 552, 552', and act as legs, supporting the device on the handles 525, 525'. As is apparent, positioning the device 500 in the upright position is not necessary to access the balls. At any time one need only remove the lid 560 (FIG. 5A), if necessary, to reveal the inside 599, and reach into the container 550. However, the upright position does permit easier access to the balls without requiring reaching to the ground. In another aspect that is not shown, a target similar to that shown in FIG. 6B can be included in the device 500.

Figure 6A:
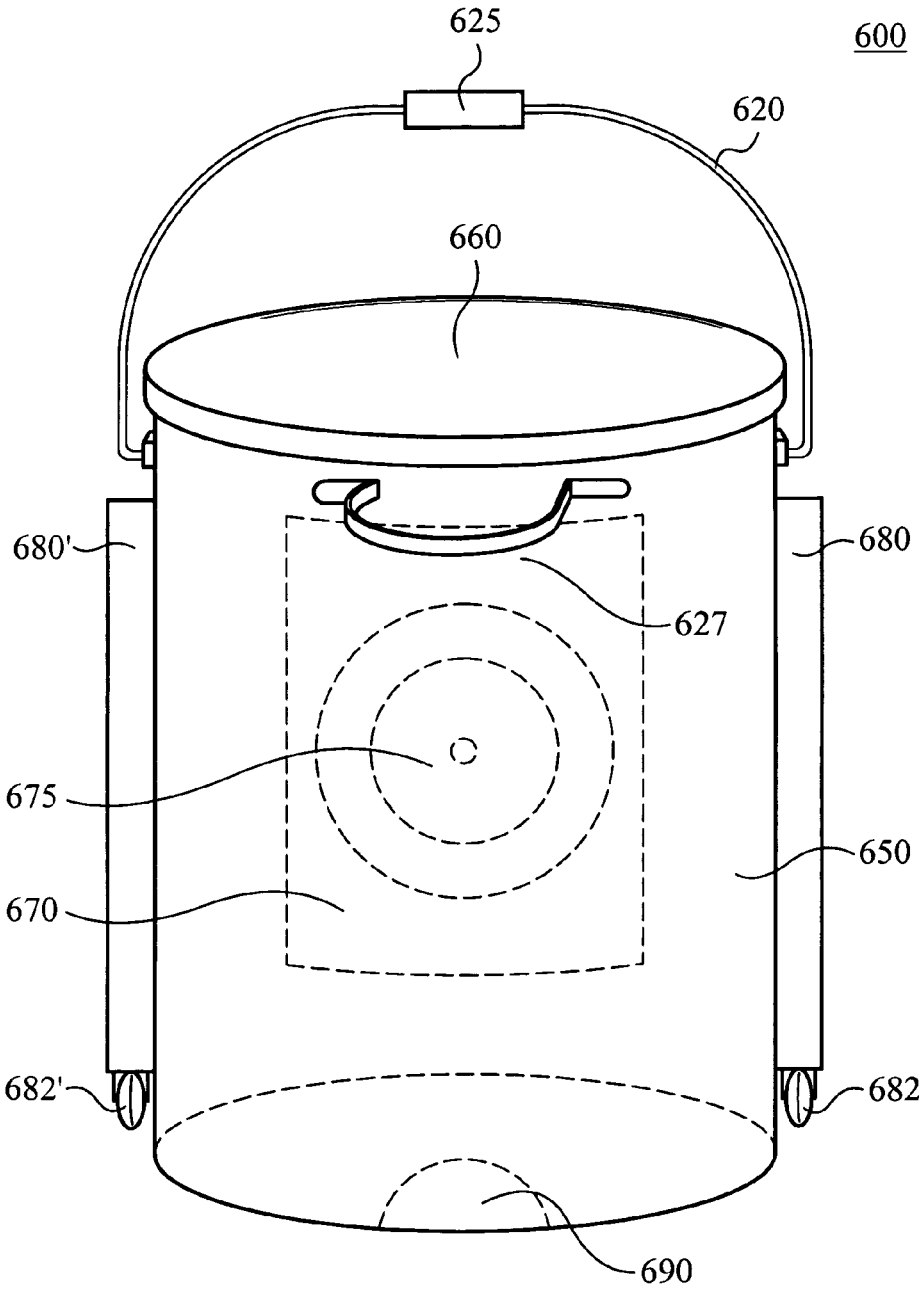
FIG. 6A is a perspective view of a wheeled ball storage bucket in a carrying/collecting configuration in accordance with the present invention.

FIG. 6A is a perspective view of a wheeled ball storage bucket 600 in a carrying/collecting configuration in accordance with the present invention. This embodiment includes a bucket-like storage container 650, but could be designed with another shape. The device preferably has a handle 625 coupled with the container 650 via the bail 620 for convenient manipulation. The device 600 also includes the wheel supporting structures 680, 680' coupled with the container 650 and configurable in at least two positions: the carrying/collecting configuration of FIG. 6A, and the upright position illustrated in FIG. 6B. In addition, the bucket 600 has at least two collecting handles 627 and 627' (not shown).

When the wheel supporting structures 680, 680' are in the carrying position, a person holding the device by the collecting handles 627 and 627' (not shown) is able to position the bottom of the container 650 on the top portion of a ball (not shown), and push down on the handles 627 and 627' (not shown), which moves the container 650 to engage and capture the ball within the ball engagement zone 690. By repeating this process, the person is able to collect multiple balls into the container 650. Other mechanisms (for example, a rigid handle 625 that locks into place) can be used to facilitate in the collection of balls.

Figure 6B:
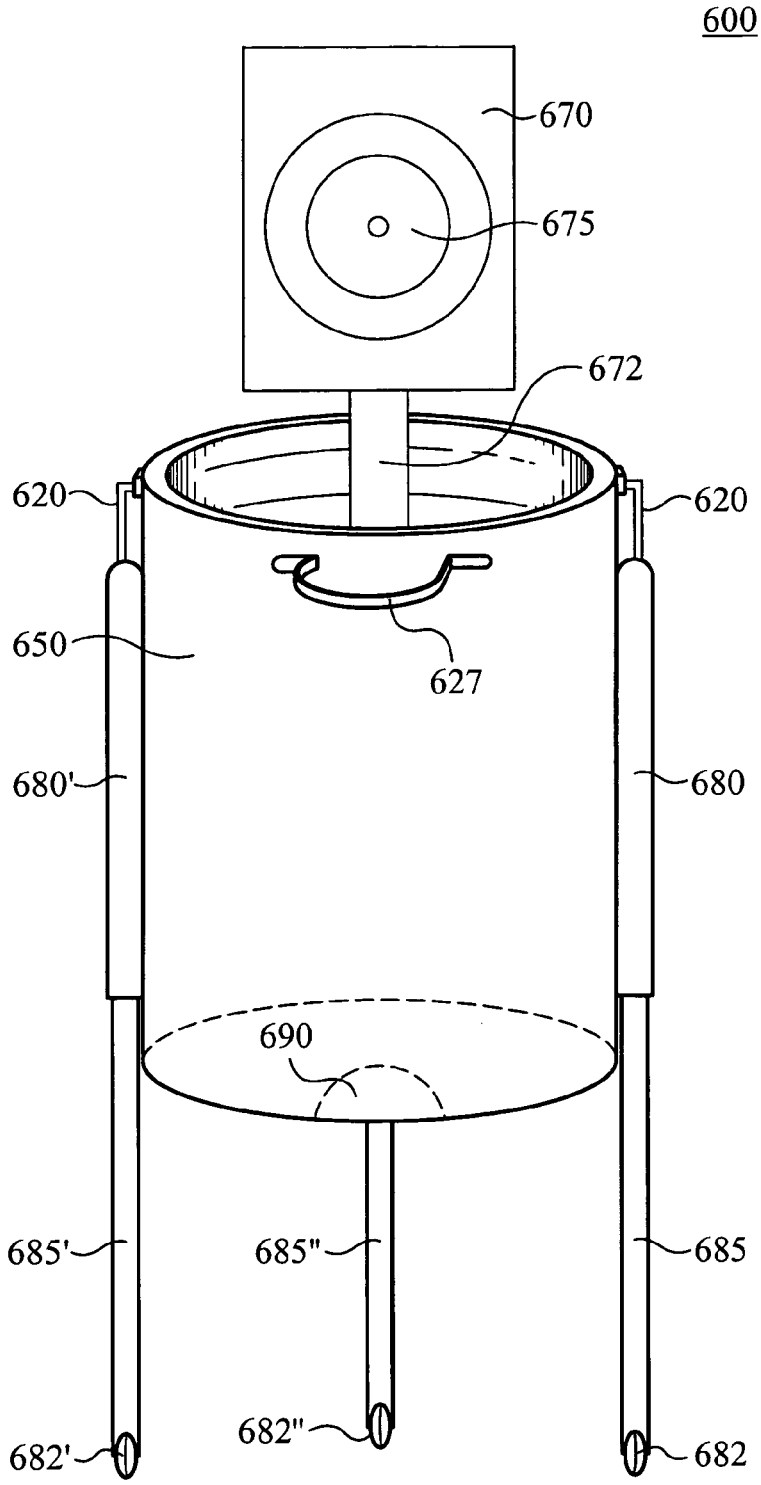
FIG. 6B is a perspective view of a wheeled ball storage bucket in a target practice configuration in accordance with the present invention.

As shown in FIG. 6B, the device 600 is also able to be configured in an upright position, where the telescoping members 685, 685' extend from the wheel supporting structures 680, 680' and couple with the wheels 682, 682' and, along with the telescoping member 685" and the wheel 682", form a three-legged support for the container 650. The telescoping member 685" and the wheel 682" couple with a third wheel supporting structure that is not shown.

With balls in the container, placing the device 600 in the upright position illustrated in FIG. 6B facilitates easy access to retrieve the balls without requiring bending down to the ground. Preferably the bail 620 can fall to the side of the container 650. Obviously, positioning the device 600 in the upright position is not necessary to access the balls. To access the balls, at any time, one need only remove the lid 660 (FIG. 6A), if necessary, and reach into the container 650. However, the upright position does permit easier access to the balls without requiring reaching to the ground.

FIG. 6B is a perspective view of a ball storage device 600 in a target practice configuration in accordance with the present invention. The target structure 670 can be used in with the device 600 in either an upright position as illustrated, or in a carrying/collecting configuration like the one illustrated in FIG. 6A. In addition, the target structure 670 is extended on the support 672 to display the target 675. The target structure 670 can be movably or removably mounted via the support 672 on the container 650. The target structure 670 is preferably soft so that some balls that hit the structure fall into the container 650. The device 600 can be placed at any selected location and placed in a target practice configuration, e.g. home plate, first base, to aid in throwing practice.

Though the ball storage bucket 600 illustrated in FIGS. 6A and 6B includes a target structure 670, inclusion of a target structure is not required within the present invention. Furthermore, in accordance with the present invention, a target structure can be included in ball storage containers of a different type than the one illustrated in FIGS. 6A and 6B. For example, in accordance with an embodiment of the present invention a target structure is included in a ball storage device of the type illustrated in FIGS. 1, 3A-F, 4A, 5A, 5B, 6A, 6B, 7A, and 7B.

FIGS. 5A, 5B, 6A, and 6B depict a loose-ball type ball collection device. The loose-ball type ball collection device differs from the elevator-style device in that successively collected balls are free to move to any open space in the device, and do not necessarily stack up vertically. While it takes longer for the vertical height of the collected balls to raise, the loose-ball style configuration partially avoids the problem of the rapid combination of weight of the collected balls on the ball capture portion.

Figure 7A:
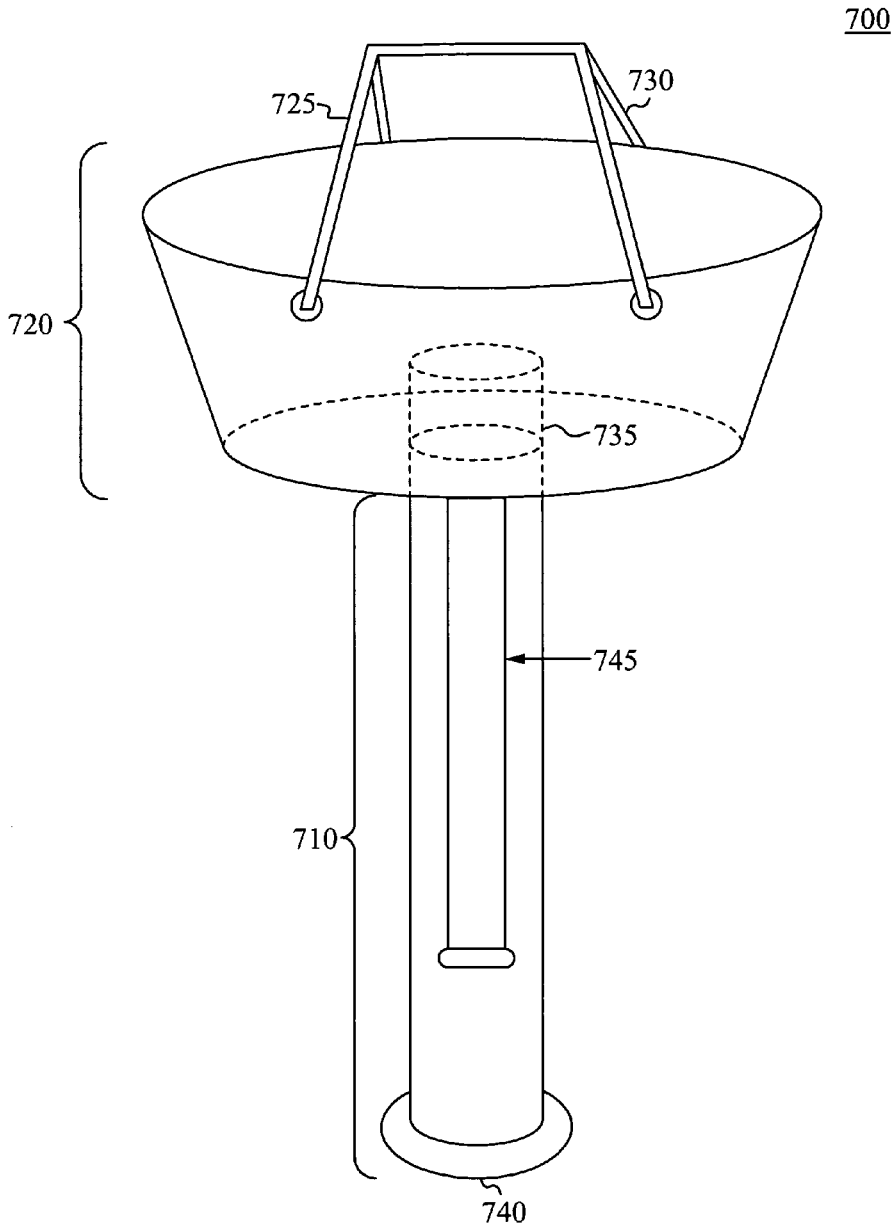
FIG. 7A is a perspective view of an upright hybrid ball collector in accordance with the present invention.
Figure 7B:
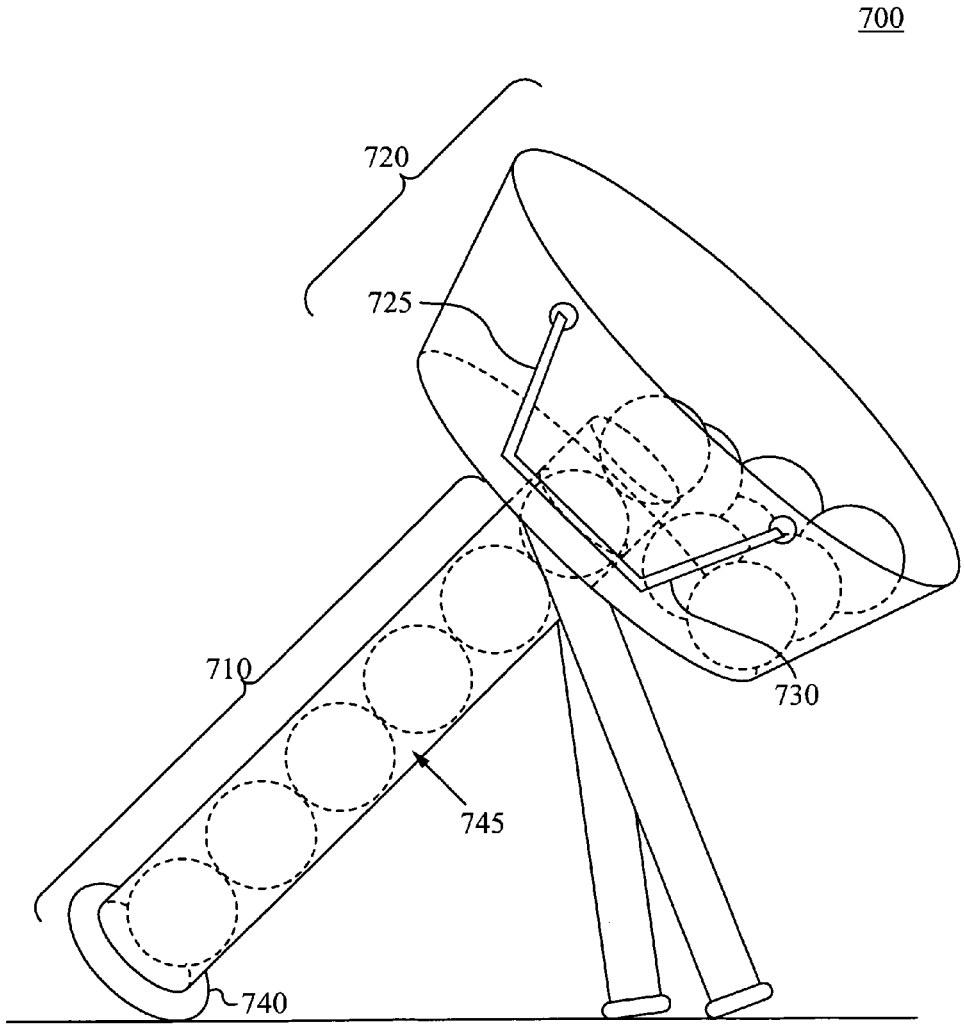
FIG. 7B is a perspective view of a leaning hybrid ball collector in accordance with the present invention.

FIG. 7A is a perspective view of a hybrid ball collector 700. The hybrid ball collector 700 has an elevator-style portion 710 as well as a loose ball storage portion 720. Two handles 725, 730 extend from the loose ball storage portion 720. Preferably, the handles are lockable to allow a user to push down on the handles in order to collect a laying ball. The handles 725, 730 are able to fold down (as shown in FIG. 7B) to allow easy access to the storage portion. Preferably, the elevator-style portion extends slightly up into the loose ball storage portion. In this configuration balls reaching the top of the elevator-style portion will spill over the side of the tube 735 to relieve some of the force due to the weight of the balls on the bendable and resilient members in the collection portion 740. The hybrid ball collector 700 can also include retractable legs 745.

When the device is in collection mode, a user will put the legs 745 in their stored position as depicted in FIG. 7A. The user pushes down on the locked handles to force the device on a laying ball. Once the user has collected balls and is ready to access them at a convenient height, the user is able to unlock and fold down the handles, fold out the legs and adjust the tilt of the device, as depicted in FIG. 7B. Preferably, merely leaning the device will automatically fold down the legs to a desired location. In the tilted position, the collected balls are easy to access, without bending over.

The embodiments of the present invention provide several advantages over traditional ball collection methods. These include the ability to retrieve substantially non-deformable balls, such as, baseballs or softballs, without having to bend down to the ground or surface area, and the ability to store baseballs or softballs in a convenient device that can be raised, lowered, tilted or wheeled to allow easy access to the stored balls without bending to reach into the device. Also the inclusion of easily positionable features coupled with a storage container for use as a practice target provides a convenient double function and allows for target practice and ball collection with a single device.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made to the embodiments chosen for illustration without departing from the spirit and scope of the invention.

What is claimed is:

1. An apparatus for collecting substantially non-deformable balls in a storage device comprising:

one or more side portions; and a bottom portion, wherein the one or more side portions and the bottom portion form a ball storage area for storing multiple substantially non-deformable balls, and wherein the bottom portion comprises a rigid frame with a rigid grid arranged as a network of horizontal and perpendicular members forming a ball intake area comprising a plurality of stretchable and resilient members located in the ball intake area, wherein the stretchable members comprise vertical and horizontal members that intersect each other at perpendicular angles, and further wherein the non-deformable balls pass through the stretchable and resilient members into the ball storage area.

2. The apparatus for collecting substantially non-deformable balls in a storage device according to claim 1, wherein the ball intake area is large enough to allow the passage of a substantially non-deformable ball therethrough, and wherein a substantially non-deformable ball cannot pass through the rigid frame, further wherein the stretchable and resilient members are configured to stretch over and around the surface of a substantially non-deformable ball with application of force on the rigid frame in the downward direction when the ball intake area is situated over the substantially non-deformable ball, and further wherein once the stretchable and resilient members stretch over the substantially non-deformable ball, the stretchable and resilient members begin to recoil back to an original position, transferring the substantially non-deformable ball through the ball intake area.

3. The apparatus for collecting substantially non-deformable balls in a storage device according to claim 1, wherein the rigid frame is further comprised of rigid members spaced out over the rigid frame, wherein spacing between the rigid members is not large enough to allow the passage of a substantially non-deformable ball therethrough.

4. The apparatus for collecting substantially non-deformable balls in a storage device according to claim 1, further comprising wheels coupled to the ball storage area, wherein the device is movable via the wheels.

5. The apparatus for collecting substantially non-deformable balls in a storage device according to claim 1, wherein at least one of the stretchable and resilient members located in the ball intake area traverses the intake area.

6. The apparatus for collecting substantially non-deformable balls in a storage device according to claim 1, wherein at least one of the stretchable and resilient members located in the ball intake area protrudes into the intake area, but does not make contact with the other side of the ball intake area or another stretchable and resilient member.

7. The apparatus for collecting substantially non-deformable balls in a storage device according to claim 1, wherein the stretchable and resilient members form a closed area in the ball intake area defining a ball acquisition area, the ball acquisition area coupled to the rigid frame.

8. The apparatus for collecting substantially non-deformable balls in a storage device according to claim 1, wherein the stretchable and resilient members comprise a stretchable and resilient grid located in the ball intake area.

9. The apparatus for collecting substantially non-deformable balls in a storage device according to claim 1, wherein the ball storage area comprises an open top.

10. The apparatus for collecting substantially non-deformable balls in a storage device according to claim 9, further comprising a removable lid to cover the ball storage area.

11. The apparatus for collecting substantially non-deformable balls in a storage device according to claim 1, wherein the ball storage area comprises an elevator type storage area having an interior only wide enough such that collected substantially non-deformable balls are vertically stacked therein, and wherein a newly collected substantially non-deformable ball causes the collected and vertically stacked substantially non-deformable balls to move up vertically in the ball storage interior.

12. The apparatus for collecting substantially non-deformable balls in a storage device according to claim 1, wherein the ball storage device comprises a loose ball storage device, of such a size that successive balls transferred through the collection area are substantially free to move to open spaces in the ball storage area.

13. The apparatus for collecting substantially non-deformable balls in a storage device according to claim 1, wherein the ball storage device comprises:

a ball elevator section, wherein successively transferred balls are vertically stacked within the ball elevator section; and a loose ball access area, wherein the ball elevator section completely fills with substantially non-deformable balls once a certain amount of substantially non-deformable balls are transferred into the ball storage device, and wherein successive substantially non-deformable balls transferred into the ball storage device after the ball elevator area is filled, spill out of the top of the ball elevator section, and into the loose ball access area.

14. The apparatus for collecting substantially non-deformable balls in a storage device according to claim 1, further comprising at least one handle coupled to the ball storage area.

15. The apparatus for collecting substantially non-deformable balls in a storage device according to claim 14, wherein the at least one handle comprises two handles configured to alternatively extend down to the side of the ball storage area and to extend up from the sides, forming a carrying position, the handles configured to lock in place when in the carrying position, wherein a user can use the handles to alternatively carry the apparatus and to push down on the handles to generate downward force on the ball storage area.

16. The apparatus for collecting substantially non-deformable balls in a storage device according to claim 1, further comprising:

a practice target, the practice target alternatively resting in the ball storage area when not in use and extending from the ball storage area for use with target practice.

17. The apparatus for collecting substantially non-deformable balls in a storage device according to claim 1, wherein at least two convertible legs are coupled to the storage device, and wherein the at least two convertible legs remain positioned at the side of the device and do not touch the ground when the device is positioned in an upright position, and further wherein the legs fold down to some angle with the vertical axis of the storage device when the storage device is tilted at an angle, and wherein the at least two convertible legs make supportive contact with the ground when folded down.

18. The apparatus for collecting substantially non-deformable balls in a storage device according to claim 17, wherein the at least two convertible legs automatically fold down to some angle when the device is tilted.

19. The apparatus for collecting substantially non-deformable balls in a storage device according to claim 1, wherein a lanyard ring is attached to the storage device.

20. An apparatus for collecting substantially non-deformable balls in a storage device comprising:

one or more side portions; and a bottom portion, wherein the one or more side portions and the bottom portion form a ball storage area for storing multiple substantially non-deformable balls, and wherein the bottom portion comprises a rigid frame with a rigid grid arranged as a network of horizontal and perpendicular members forming a ball intake area, the ball intake area further comprising a plurality of stretchable and resilient members located in the ball intake area, wherein the stretchable members comprise vertical and horizontal members that intersect each other at perpendicular angles, and further wherein the non-deformable balls pass through the stretchable and resilient members into the ball storage area, wherein the ball intake area is large enough to allow the passage of a substantially non-deformable ball therethrough, and wherein a substantially non-deformable ball cannot pass through the rigid frame, further wherein the stretchable and resilient members are configured to stretch over and around the surface of a substantially non-deformable ball with the application of force on the rigid frame in the downward direction when the ball intake area is situated over the substantially non-deformable ball, further wherein once the stretchable and resilient members stretch over the substantially non-deformable ball, the stretchable and resilient members begin to recoil back to an original position, transferring the substantially non-deformable ball through the ball intake area.

21. The apparatus for collecting substantially non-deformable balls in a storage device according to claim 20, wherein at least one of the stretchable and resilient members located in the ball intake area traverses the intake area.

22. The apparatus for collecting substantially non-deformable balls in a storage device according to claim 20, wherein at least one of the stretchable and resilient members located in the ball intake area protrudes into the intake area, but does not make contact with the other side of the ball intake area or another stretchable and resilient member.

23. The apparatus for collecting substantially non-deformable balls in a storage device according to claim 20, wherein the stretchable and resilient members form a closed area in the ball intake area defining a ball acquisition area, the ball acquisition area coupled to the rigid frame.

24. The apparatus for collecting substantially non-deformable balls in a storage device according to claim 20, wherein the stretchable and resilient members comprise a stretchable and resilient grid located in the ball intake area.

25. The apparatus for collecting substantially non-deformable balls in a storage device according to claim 20, wherein the ball storage area comprises an elevator type storage area having an interior only wide enough such that collected substantially non-deformable balls are vertically stacked therein, and wherein a newly collected substantially non-deformable ball causes the collected and vertically stacked substantially non-deformable balls to move up vertically in the ball storage interior.

26. The apparatus for collecting substantially non-deformable balls in a storage device according to claim 20, wherein the ball storage device comprises a loose ball storage device, of such a size that successive balls transferred through the collection area are substantially free to move to open spaces in the ball storage area.

27. The apparatus for collecting substantially non-deformable balls in a storage device according to claim 20, wherein the ball storage device comprises:

a ball elevator section, wherein successively transferred balls are vertically stacked within the ball elevator section; and a loose ball access area, wherein the ball elevator section completely fills with substantially non-deformable balls once a certain amount of substantially non-deformable balls are transferred into the ball storage device, and wherein successive substantially non-deformable balls transferred into the ball storage device after the ball elevator area is filled, spill out of the top of the ball elevator section and into the loose ball access area.

28. The apparatus for collecting substantially non-deformable balls in a storage device according to claim 20, further comprising at least one handle coupled to the ball storage area, wherein the at least one handle comprises two handles configured to alternatively extend down to the side of the ball storage area and to extend up from the sides, forming a carrying position, the handles configured to lock in place when in the carrying position, wherein a user can use the handles to alternatively carry the apparatus and to push down on the handles to generate downward force on the ball storage area.

29. The apparatus for collecting substantially non-deformable balls in a storage device according to claim 20, further comprising:

a practice target, the practice target alternatively resting in the ball storage area when not in use and extending from the ball storage area for use with target practice.

30. A method of assembling a substantially non-deformable ball collection device comprising:

forming a storage area from one or more side portions;

forming a bottom portion, wherein the bottom portion comprises a rigid frame with a rigid grid arranged as a network of horizontal and perpendicular members forming a ball intake area, wherein the ball intake area is larger than the diameter of a substantially non-deformable ball;

coupling a plurality of stretchable and resilient members to the ball intake area, wherein the stretchable members comprise vertical and horizontal members that intersect each other at perpendicular angles, and further wherein the stretchable and resilient members divide the ball intake area into sections smaller than the diameter of a substantially non-deformable ball, wherein non-deformable balls pass through the stretchable and resilient members into the storage area; and coupling the storage area to the bottom portion.

31. The method of assembling a substantially non-deformable ball collection device according to claim 30, wherein the ball storage area and the bottom section with a ball collection portion are integrally formed.

32. The method of assembling a substantially non-deformable ball collection device according to claim 30, wherein the ball storage area and the bottom section with a ball collection portion are removably coupled.

33. The method of assembling a substantially non-deformable ball collection device according to claim 30, wherein the ball storage area and the bottom section with a ball collection portion are coupled with brackets and fasteners.

34. An apparatus for collecting substantially non-deformable balls in a storage device comprising:

one or more side portions;

a bottom portion, wherein the one or more side portions and the bottom portion form a ball storage area for storing multiple substantially non-deformable balls, and wherein the bottom portion has a rigid frame with a ball intake area comprising a plurality of stretchable and resilient members located in the ball intake area, wherein the non-deformable balls pass through the stretchable and resilient members into the ball storage area, wherein the stretchable and resilient members form a closed area within the ball intake area defining a ball acquisition area; and a plurality of wheels coupled to the ball storage area, wherein the device is movable via the wheels.

35. An apparatus for collecting substantially non-deformable balls in a storage device comprising:

one or more side portions;

a bottom portion, wherein the one or more side portions and the bottom portion form a ball storage area for storing multiple substantially non-deformable balls, and wherein the bottom portion has a rigid frame with a ball intake area;

a plurality of wheels coupled to the ball storage area, wherein the device is movable via the wheels; and a practice target alternatively resting in the ball storage area when not in use and extending from the ball storage area for use with target practice.

36. An apparatus for collecting substantially non-deformable balls in a storage device comprising:

one or more side portions;

a bottom portion, wherein the one or more side portions and the bottom portion form a ball storage area for storing multiple substantially non-deformable balls, and wherein the bottom portion has a rigid frame with a ball intake area, the ball intake area further comprising at least one stretchable and resilient member located in the ball intake area, wherein the ball intake area is large enough to allow the passage of a substantially non-deformable ball therethrough, and wherein a substantially non-deformable ball cannot pass through the rigid frame, further wherein the at least one stretchable and resilient member is configured to stretch over and around the surface of a substantially non-deformable ball with the application of force on the rigid frame in the downward direction when the ball intake area is situated over the substantially non-deformable ball, further wherein once the at least one stretchable and resilient member stretches over the substantially non-deformable ball, the at least one stretchable and resilient member begins to recoil back to its original position, transferring the substantially non-deformable ball through the ball intake area; and a practice target alternatively resting in the ball storage area when not in use and extending from the ball storage area for use.

37. A ball storage device for collecting substantially non-deformable balls comprising:

a ball storage area; and a bottom comprising a grid of rigid and flexible members arranged as a network of horizontal and perpendicular members, wherein the flexible members comprise vertical and horizontal members that intersect each other at perpendicular angles;

wherein the flexible members form an inside portion of the grid and the rigid members form an outside portion of the grid such that the outside portion of the grid completely surrounds the inside portion, and further wherein the flexible members flex to admit a non-deformable ball directly into the ball storage area.

* * * * *